United States Patent [19]

Strobe et al.

[11] 4,106,662

[45] Aug. 15, 1978

[54] EASY-OPEN CONTAINER WITH FLANGE PUSH-IN MEMBER

[76] Inventors: Carl J. Strobe, 2831 Orchard Knob; Robert A. Wells, 4450 Harris Trail, N.W., both of Atlanta, Ga. 30327

[21] Appl. No.: 796,510

[22] Filed: May 13, 1977

Related U.S. Application Data

[62] Division of Ser. No. 580,624, May 27, 1975, Pat. No. 4,023,703.

[51] Int. Cl.[2] ..... B65D 41/32

[52] U.S. Cl. ..... 220/268; 220/345

[58] Field of Search ..... 220/265–273, 220/345, 346; 222/541

[56] References Cited

U.S. PATENT DOCUMENTS

| | | | |
|---|---|---|---|
| 2,261,117 | 11/1941 | Jack, Jr. | 220/269 |
| 3,813,000 | 5/1974 | Underwood | 220/269 |
| 3,915,333 | 10/1975 | Peyser et al. | 220/268 |

*Primary Examiner*—George T. Hall
*Attorney, Agent, or Firm*—Jones, Thomas & Askew

[57] ABSTRACT

An easy-open container having a wall in which an openable member is integrally formed and defined by a selectively separable region. The openable member has an opening tab which is raised outwardly from the container wall, with the opening tab having a flange which overhangs at least part of the separable region. Finger pressure applied inwardly onto the opening tab toward the container wall causes the separable region to become ruptured, allowing the openable member to move inwardly with respect to the wall. Inward movement of the openable member is limited by the overhanging flange which contacts the periphery of the opening. The separated opening member is retained on the container wall and is then displaced to reveal an opening in the container wall for access to the contents of the container. Several openable members are disclosed which can reclose the opened container. The opening tab is be an integral part of the openable member.

14 Claims, 22 Drawing Figures

EASY-OPEN CONTAINER WITH FLANGE PUSH-IN MEMBER

This is a division of application Ser. No. 580,624, filed May 27, 1975, now U.S. Pat. No. 4,023,703.

This invention relates in general to containers and in particular to easy-open containers of the type typically used for commodities such as beverages and the like.

The widespread popularity of easy-open containers, particularly containers of the well-known "poptop" variety used for beverages and the like, has created problems because of the complete removability from the container of the tear tab or other easy-opening structure. The removable tear tabs, which usually have rough torn metal edges, have created a litter problem which is both unsightly and hazardous. Moreover, the relatively small size of the typical pop-top tear tab seemingly invites improper disposal of the tear tab, since such tabs are frequently found underfoot in even the more remote locations.

Notwithstanding the disadvantages of the removable tear tab which accompanies the conventional pop-top container, consumer acceptance of such containers is high because these containers are readily openable by people of nearly all ages, without resort to can openers or other external implements. Because of this popularity, numerous attempts have been made to provide alternative easy-opening containers which provide the advantages of the conventional pop-top while overcoming the aforementioned litter problem. Such prior art alternative containers are not known to have met with any degree of commercial success, however, because these containers proved difficult to open or were excessively expensive to manufacture. Moreover, some proposed easy-open containers present the user with the real or perceived possibility that his finger may suddenly be propelled through the sharp edges of an opening from which a tear tab has just been removed. Containers which present this hazard, whether real or merely perceived, have been completely unacceptable to beverage manufacturers as well as consumers in test market situations.

According to the present invention, accordingly, there is provided a unique and novel easy-open container in which an openable member integral with a wall of the container is defined in the wall by a selectively separable region of predetermined weakness. The openable member is formed to have an opening tab which extends outwardly from the container wall, and a recess may be defined in the opening tab for receiving finger pressure directed inwardly toward the container wall. A portion of the openable member overhangs the selectively separable region to limit the inward movement of the separated openable member, thereby preventing entry of the button and one's finger into the opening which is provided by rupture of the separable region. The separated opening member can thereafter either be completely removed from the container wall, or can alternatively be retained on the container wall by appropriate structural means; the retained openable member is selectively displaceable relative to the container wall for access to the contents of the container.

Accordingly, it is an object of the present invention to provide improved easy-open container apparatus.

It is another object of the present invention to provide improved easy-open container apparatus in which a separable opening member is retained on the opened container.

It is yet another object of the present invention to provide an easy-open container of relatively economical construction, in which the openable portion cannot be detached from the remainder of the container.

It is still another object of the present invention to provide an easy open container wall of unitary construction.

It is a further object of the present invention to provide an easy-open container in which the opening structure has neither the real nor the apparent capability of allowing a person's finger to accidentally enter the container during opening.

Other objects and advantages of the present invention will become more readily apparent from the following description of several disclosed embodiments thereof, including the drawings in which.

Figure 1:
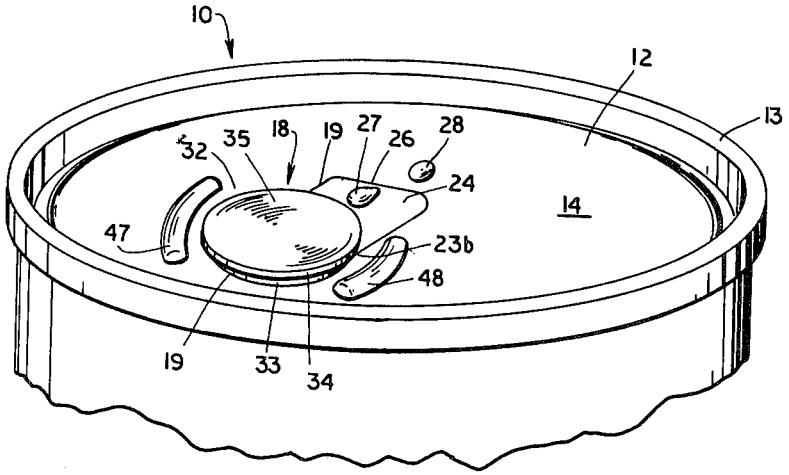
FIG. 1 shows a fragmentary pictorial view of a container including an end wall provided with easy-opening structure according to one disclosed embodiment of the present invention.

Turning first to the embodiment shown in FIGS. 1-5, there is shown a fragmentary container indicated generally at 10 and having a generally cylindrical body wall 11 and an end wall 12 secured to the body wall by the peripheral chime 13 which extends a short distance beyond the outside surface 14 of the end wall, in a manner well-known to those skilled in the art. It will be understood that the non-depicted portion of the container 10 includes the remainder of the body wall 11 and another end wall, which may be formed integrally with the body wall or which may alternatively be a separate end member which is fastened to the body wall.

Figure 3:
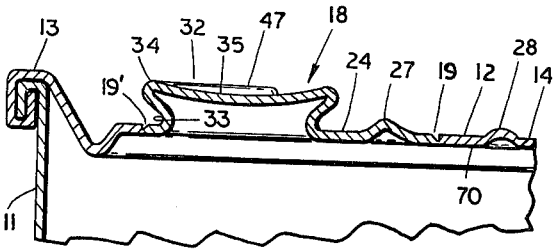
FIG. 3 is an elevation view taken along line 3—3 of FIG. 2.
Figure 3A:
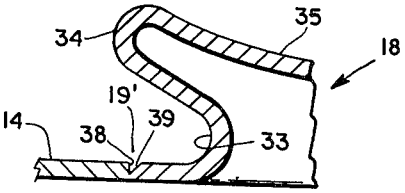
FIG. 3A is an enlarged fragmentary view of the score line used in the embodiment of FIG. 3.

Located in the end wall 12 is the openable member indicated generally at 18 and defined in the end wall by the line 19 of predetermined structural weakness formed in the end wall. Assuming that the end wall 12 is made of thin metal such as aluminum or the like, the line of weakness 19 can be provided by a score line which is stamped into the wall in a manner known to those skilled in the art. The score line 19 may extend only partially through the thickness of the end wall 12, as best shown in FIGS. 3 and 3A, or may alternatively be a repaired score in which the openable member 18 is initially severed from the end wall at the time of manufacture, after which the severed end wall is repaired by applying a suitable sealant composition along the line of severing at the inside surface 20 of the end wall. Various types of metal scoring techniques and metal weakening techniques used in easy-open container construction are known to those skilled in the art and, with an exception below, are repeated in further detail herein.

The line of weakness 19, hereinafter called a "score line" without regard to its manufacturing technique, which defines the openable member 18 is an uninterrupted line, so that the openable member is completely separated from the remainder of the end wall 12 when the score line becomes separated. The score line 19, in the embodiment of FIGS. 1–5, thus defines the openable member as including an arcuate portion defined by the score line segment 19' which, in the presently-discussed embodiment, is curvilinear and extends over slightly more than 180° to join at 23*a* and 23*b* with the remainder of the score line which defines a tab section 24 extending generally toward the center of the end wall 12. The tab section 24, in the present embodiment, includes and is defined in part by a pair of spaced-apart sides 25*a* and 25*b* and by the outer end 26.

Formed in the tab section 24 is an outwardly-extending locking detent 27, which is aligned with a mating locking dimple 28 formed in the inside surface 20 of the end wall 12. The purpose and operation of the locking detent 27 and the locking dimple 28 are explained below. Both the locking detent 27 and the locking dimple 28 are preferably formed by a stamping operation during the manufacture of the end wall 12.

Figure 2:
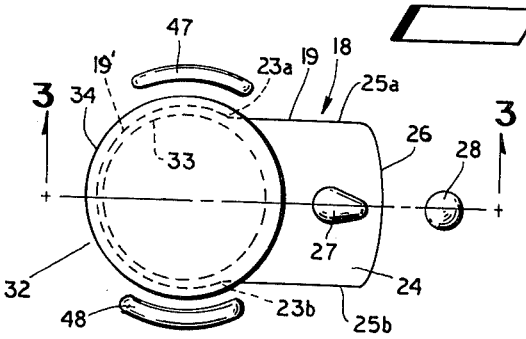
FIG. 2 shows a top plan view of the container end shown in FIG. 1.
Figure 4:
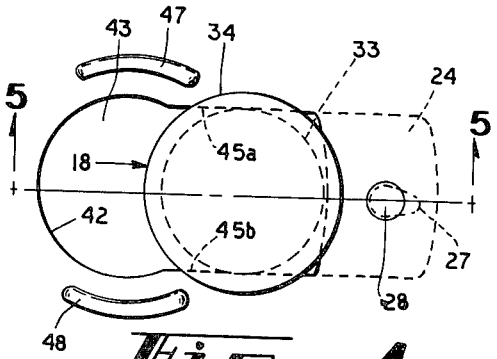
FIG. 4 is a top plan view of an opened container of the type shown in FIG. 1.

The openable member 18 is also provided with an opening tab in the form of a button 32 which, in the disclosed embodiment, is an integral part of the openable member and which is spaced a distance above the outside surface 14 of the end wall 12. The outermost extent of the button 32 preferably is below the chime 13, however, as best seen in FIG. 3. The outwardly-extended button 32 is defined by a peripheral wall 33 which is deformed from the nominal plane of the end wall 12 to extend outwardly a distance from the end wall; the button is further formed and defined by a flange 34 which, in the embodiment of FIGS. 1–5, overhangs substantially the entire arcuate score line segment 19'. The overhanging relation of the flange 34 and the score line segment 19' is best shown in FIGS. 2 and 3. The top of the button 32 is domed inwardly at 35 to provide a convenient recess for receiving the finger or thumb of a person opening the container. The wall 33 is necked inwardly from the score line to form a channel which allows the openable member 18, when separated from the end wall 12, to be moved with respect to the end wall.

A detailed view of the scoring used for the embodiments of FIGS. 1–5 is shown in FIG. 3A, showing that the score line 19' (as well as at 19) has an assymmetrical cross-section. One side 38 of the score 19' is substantially perpendicular to the outside surface 14 of the end wall, while the other side 39 of the score is diagonally inclined from the outside surface to form an acute angle with the vertical side 38. The purpose of the particular depicted scoring is made apparent below, although it will become apparent that alternative scoring techniques may be employed. Those skilled in the art will recognize that the type of scoring shown in FIG. 3A is sometimes known as the "Alcoa B-48" score, wherein the diagonal side 39 and the perpendicular side 38 meet at an included angle in the order of 45°.

The operation of the embodiment described in FIGS. 1–5 is now discussed. A person desiring to open the container 10 must press downwardly with a thumb or finger on the domed region 35 of the button 32, and this downward pressure exerts a force on the score line 19 (including the segment 19') which causes the score line to rupture; the openable member 18 thus becomes separated from the end wall 12. Rupturing of the score line 19 in the disclosed embodiment is enhanced by the off-center location of the button 32, relative to the longitudinal extent of the openable member 18 as viewed in FIG. 3. When the off-center button 32 is pressed inwardly toward the end wall 12, the force applied to the button is unevenly distributed throughout the score line 19, and concentrations of force-induced stress will occur at one or more locations along the score line. The score line initially ruptures at a point or points of stress concentration, and the resulting initial rupture allows the openable member 18 to undergo a degree of inward movement, relative to the end wall 12, which produces more stress and causes the remainder of the score line 19 to become ruptured.

Figure 5:
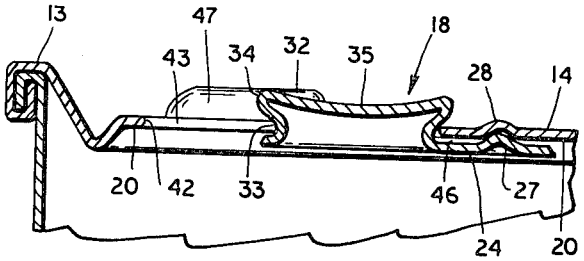
FIG. 5 is a section view taken along line 5—5 of FIG. 4.
Figure 5A:
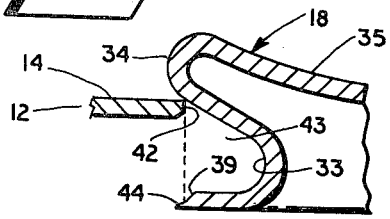
FIG. 5A is an enlarged fragmentary view of the score line of FIG. 3A, immediately after becoming separated.

As soon as the score line 19 is ruptured, the openable member 18 can move inwardly toward the outside surface 14. However, the extent of inward movement is limited by the flange 34, which overhangs the score line segment 19' and which has moved into contact with the outside surface 14 surrounding the peripheral edge 42. This contact is best seen in FIG. 5A. Since the opener's finger was placed on the domed area 35 to press the button 32 downwardly, it is apparent that the finger cannot inadvertently enter the opening 43 in the end wall 12 at this time and, indeed, cannot even contact the roughened peripheral edge 42 which is presently beneath the overhanging flange 34.

It is also apparent from FIG. 5A that the diagonal side 39 of the score 19 became ruptured along a surface 44 which is substantially a continuation of the diagonal surface, with the result that the surface 44 underhangs the peripheral edge 42 of the opening 43 to an extent which prevents the openable member 18 from being completely detached from the end wall 12 by pulling the opening structure outwardly through the opening. As a result, the openable member 18, although now separated from the end wall 12, remains captivated by the end wall.

The opening procedure is completed by sliding the openable member a distance to the right (as viewed in FIGS. 4 and 5) so that the openable member becomes displaced from a portion of the opening 43. This displacement occurs as the tab section 24 slides beneath the end wall 12, with the locking detent 17 being moved into detent engagement with the locking dimple 28 as shown in FIG. 5. Opening of the container 10 is now completed, and the contents of the container may be poured or consumed directly from the container opening 43 in the manner known to those skilled in the art.

The longitudinal sliding of the openable member 18 is facilitated by the closely-spaced sliding connection between the channel provided by the necked peripheral wall 33 of the openable member, and the spaced-apart peripheral edges 45*a* and 45*b* which remain when the sides 25*a* and 25*b* of the tab 24 became separated from the end wall 12. The spacing between the two sides 45*a* and 45*b*, relative to the corresponding distance across the necked peripheral wall 33, must be sufficient to allow the aforementioned longitudinal sliding movement without being so large as to permit the openable member 18 either to be withdrawn completely from the end wall 12, or to fall through the opening 43 into the interior of the container 10. The spacing between the sides 45*a* and 45*b* is slightly reduced from the maximum diameter of the arcuate of the score line segment 19', as best shown in FIG. 2, to facilitate retention of the opening structure 17.

The height of the locking detent 27, relative to the depth of the locking dimple 28 in the inside surface 20, causes the tab section 24 to be disposed downwardly a distance below the inside surface as shown in FIG. 5, so that a space 46 is provided between the inside surface of the end wall and the tab section to vent air into the container 10 as the contents of the container are being poured or consumed through the opening 43.

Reviewing the operation of the embodiment shown in FIGS. 1–5, the openable member 18 has been separated from its previous integral relation with the end wall 12 and has been moved longitudinally of the end wall to be locked in an opened position allowing access to the contents of the container. The openable member 18 remains captivated on the end wall 12 of the container, however, and the openable member cannot fall into the interior of the container. The flange 34 prevents the button 32 and the user's finger from coming into engagement with the peripheral edge 42 of the opening 43 in the container, and the presence of the flanged button 32 provides psychological as well as actual assurance that the container can be manually opened with no risk of personal injury.

It may be desired to form the smile beads 47 and 48 on either side of the button 32, to prevent the openable member 18 from becoming inadvertently opened when a number of the containers 10 are being vertically stacked. The smile beads 47 and 48 should preferably extend outwardly from the outside surface 14 of the end wall 12 to extend just beyond the outermost extent of the button 32. The smile beads 47 and 48 may also have a desirable stiffening effect on the end wall 12 surrounding the openable member, although in some applications it may be desirable to forego the smile beads.

Figure 6:
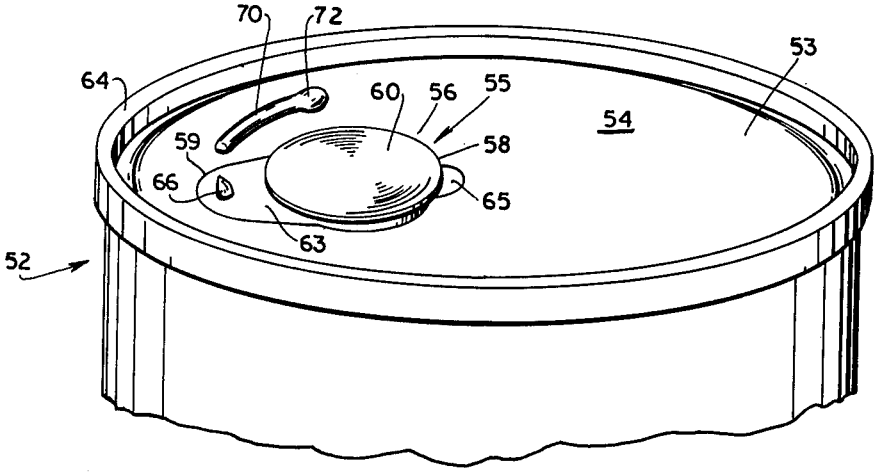
FIG. 6 is a fragmentary pictorial view of a container provided with easy-open structure according to another disclosed embodiment of the present invention.
Figure 7:
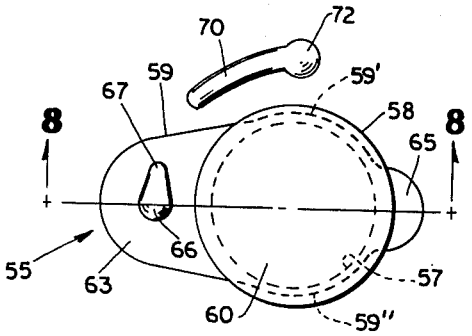
FIG. 7 is a top plan view of the embodiment shown in FIG. 6.

The embodiment of the present invention shown in FIGS. 6–11 has an openable member which is rotatable to expose the opening into the container, rather than sliding as in the previously-described embodiment. Turning to FIG. 6, there is shown a container indicated generally at 52 and including an end wall 53 having an outside surface 54. An openable member indicated generally at 55 is defined in the end wall 53 by the score line 59, and the openable member is preferably integral with the end wall in a manner similar to the previous embodiment. The openable member includes an opening tab in the form of a button 56 which extends a distance outwardly from the outside surface 54 of the end wall 53, with the button 56 being formed above and integrally with the necked channel provided by the annular peripheral wall 57. A flange 58 is formed on the button 56 surrounding and spaced outwardly from the peripheral wall 57, and it is apparent in FIG. 7 that the flange 58 overhangs curvilinear segments 59' and 59'' of the score line 59 which defines the openable member 55 in the end wall 53. An inwardly-domed depression 60 in the button 32 provides a finger-receiving area.

The openable member 55 has a first tab section 63 which extends from the button 56 a distance toward the chime 64 of the container 52. The openable member 55 also has a second tab section 65 which extends from the button 56 a distance toward the center of the end wall 53. A locking detent 66 is formed in the first tab section 63 to extend a distance outwardly from the outside surface 54 of the end wall 53, and it can be seen from FIG. 7 that the locking detent 66 may have a narrow end 67 directed approximately at right angles to the longitudinal axis defined by the tab section 63 and the button 56.

A locking track 70 is formed in the end wall 53 to extend upwardly from the inside surface 71 of the end wall. The locking track 70 is arc-shaped and is situated on the end wall 53 to receive the locking detent 66 when the openable member 55 is separated from the end wall 53 and rotated, as described below. The locking track 70 has an enlarged area 72 at one end, to receive and retain the locking detent 66.

The operation of the embodiment shown in FIGS. 6–11 is now described. The openable member 55 is initially separated from the end wall 53 in substantially the same manner as previously described, namely, by pressing downwardly on the domed depression 60 with finger or thumb. The resulting inwardly-directed force applies stress to rupture the score line 59, so that the openable member 55 becomes separated from the remainder of the end wall 53 and moves inwardly toward the end wall 53. The flange 58 contacts the overhung portions of the outside surface 54 which are adjacent the former score segments 59' and 59'', thereby preventing the button from entering the opening 73 in the end wall.

Figure 9:
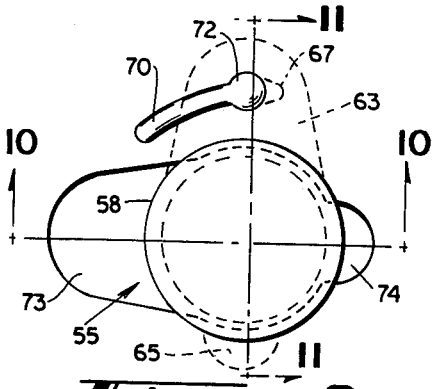
FIG. 9 is a top plan view showing the embodiment of FIG. 6 in opened position.
Figure 8:
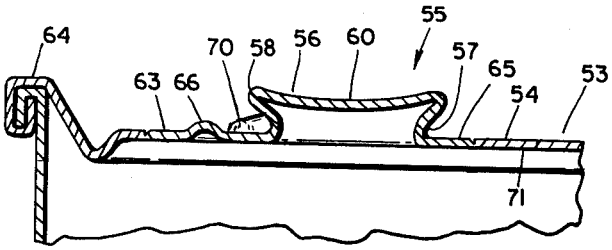
FIG. 8 is a section view taken along line 8—8 of FIG. 7.
Figure 11:
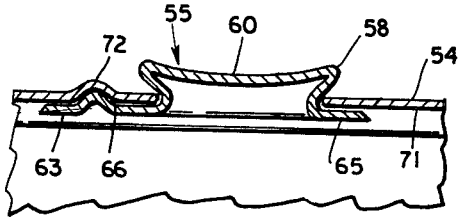
FIG. 11 is a section view taken along line 11—11 of FIG. 9.
Figure 10:
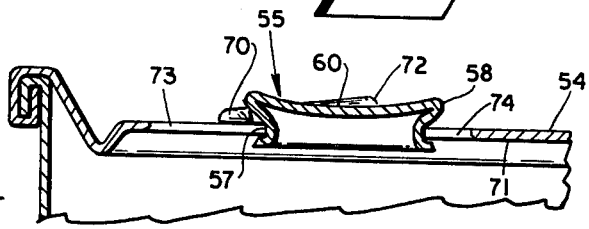
FIG. 10 is a section view taken along line 10—10 of FIG. 9.
Figure 12:
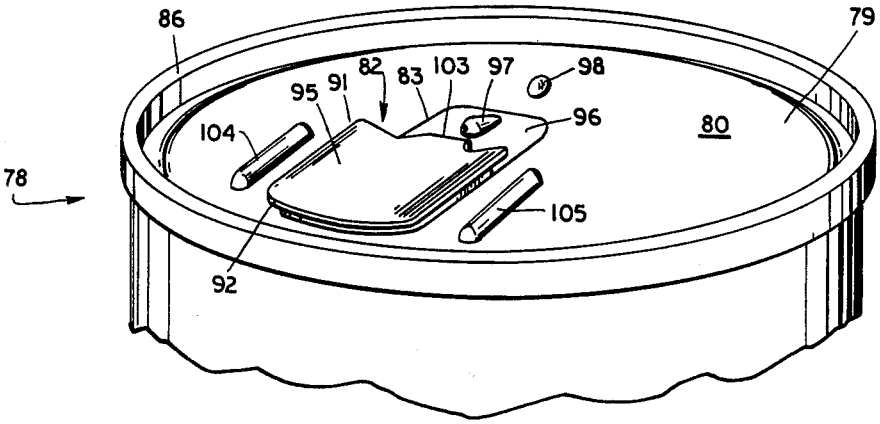
FIG. 12 is a fragmentary pictorial view of a container provided with easy-open end structure according to still another disclosed embodiment of the present invention.
Figure 13:
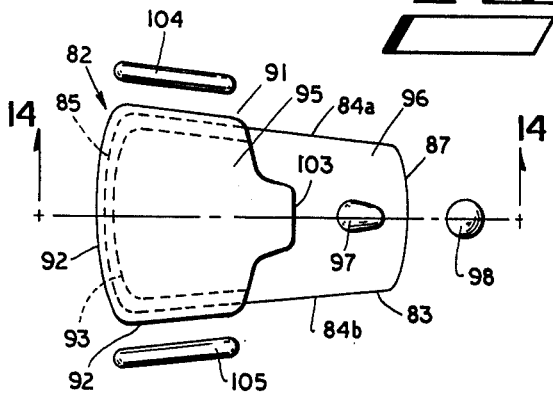
FIG. 13 is a top plan view of the embodiment shown in FIG. 12.

The button 56 is now grasped by the flange 58 and the openable member 55 is rotated clockwise approximately 90° to the position shown in broken lines in FIG. 9, so that the first tab section 63 and the second tab section 65 are disposed beneath the end wall 63 of the container 52. The necked channel provided by the peripheral wall 57 allows the openable member 55 to be rotatably received within the confronting curvilinear edges provided by the former score segments 59' and 59''. Such rotation of the openable member 55 moves the locking detent 60 along the inside surface 71 of the end wall 53 to enter and move along the locking track 70, until the locking detent enters and is retained in the enlarged area 72 at the end of the locking track.

Opening of the container 52 is now completed, and a pair of openings 73 and 74 remain in the end wall 53 by separation and displacement of the respective tab sections 63 and 65. The larger opening 73, being closer to the chime 64 of the container 52, provides a drinking or pouring opening while the opening 74 provides an air vent into the container. As with the embodiment described in FIGS. 1–5, the openable member 55 cannot enter the container 52 and the flange 58 protects fingers from inadvertently contacting the peripheral edges of the openings while the button 56 is being forced downwardly to sever the score line 59. The embodiment of FIGS. 6–11 can also be provided with the score structure shown in FIGS. 3A and 5A, if desired, to captivate the openable member 55 onto the end wall 53.

Still another disclosed embodiment of the present invention is shown in FIGS. 12–16, wherein the container shown generally at 78 has an end wall 79 with an outside surface 80 on which is disposed an openable member indicated generally at 82. Although the openable member 82, which is defined by an uninterrupted score line 83, becomes completely detached from the end wall 79 during opening and thereafter slides toward the center of the end wall, as does the embodiment shown in FIGS. 1–5, the openable member 82 of the presently-discussed embodiment has no curvilinear or arcuate portions. Instead, the openable member 82 is defined by score line portions 84*a* and 84*b* which taper inwardly from a relatively wide end score line 85, positioned adjacent the chime 86 of the container, to the relatively narrow inner end score line portion 87, which is positioned toward the center of the end wall 79. The score line portions 84*a* and 84*b*, accordingly, form a wedge-shaped pair of nonparallel score line segments which converge toward the inner segment 87 of the score line.

Figure 14:
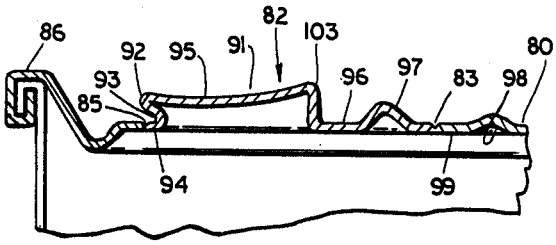
FIG. 14 is a section view taken along line 14—14 of FIG. 13.

A button 91 forms an opening tab which is integrally formed on the openable member 82 at the end nearest the wide score line portion 85, with the button 91 being raised above the outside surface 80 of the end wall 79. As best shown in FIG. 14, the button 91 has a peripheral flange 92 which is spaced above the outside surface 80 and which overhangs the end score portion 85, as well as parts of the side score line portions 84*a* and 84*b*.

The button 91 is necked inwardly beneath the flange 92, as shown at 93, to define a sliding channel located between the flange and the segment 94 of the openable member which extends forwardly to the score line 83.

An inward concave area 95 is provided on the top of the button 91 to receive finger or thumb pressure during opening. As particularly shown in FIG. 14, the concave area 95 may be skewed somewhat toward the forward score line portion 85 to provide an even more unequal distribution of stress on the score line 83 when the button 91 is pressed downwardly.

Extending from the button 91 toward the center of the end wall 79 is the tab portion 96, which is bounded by the side score line portions 84*a* and 84*b* and the end score line portion 87. A locking detent 97 extends outwardly from the outer surface of the tab portion 96, and a mating locking dimple 98 is formed in the inside surface 99 of the end wall 79. A stop member 103 is formed on the rear of the button 91, facing toward the center of the end member 79, with the stop member extending above the outside surface of the tab portion 96 at a predetermined location relative to the tab portion.

A pair of smile beads 104 and 105 may be formed in the end wall 79 in opposed flanking relation alongside the button 91. The smile beads 104 and 105, if provided, preferably extend upwardly from the outside surface 80 sufficiently to extend just above the outermost point of the button 91, so that the openable member 82 is protected from inadvertent opening when containers are vertically stacked.

The opening operation of the embodiment shown in FIGS. 12–16 is now discussed. Opening is initiated substantially in the manner discussed above with previous embodiments, with the entire score line 83 being ruptured by downward pressure applied to the concave area 95 of the button 91. After the score line is ruptured, the entire openable member 82 moves downwardly until the overhanging flange 92 contacts the area of the outside surface 80 which surrounds the score line side portions 84*a* and 84*b*, as well as the front end score line portion 85, thus preventing further movement of the openable member into the container. The tab portion 96 is now below the inside surface 99 of the end wall 79, and the openable member 82 is free to be moved back toward the center of the end wall to expose the opening 106 into the container.

Figure 16:
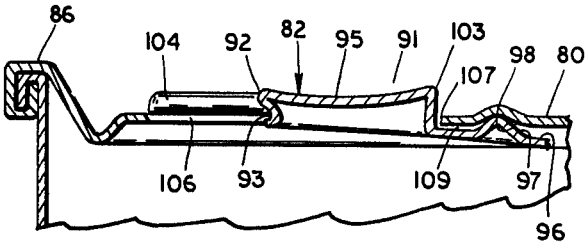
FIG. 16 is a section view taken along line 16—16 of FIG. 15.

The openable member 82 is moved back until the locking detent 97 is received in the locking dimple 98, as shown in FIG. 16, to retain the openable member in the fully-open position. The stop member 103 is positioned to be in substantial abutting contact with the innermost edge 107 of the opening 106 when the openable member is fully open. The areas 108*a* and 108*b* of the tab portion 96 are now in air vent communication into the container 78 through the space 109 (FIG. 16) maintained between the inside surface 99 of the end wall 79 and the tab portion by contact of the locking detent 97 within the dimple 98.

Figure 15:
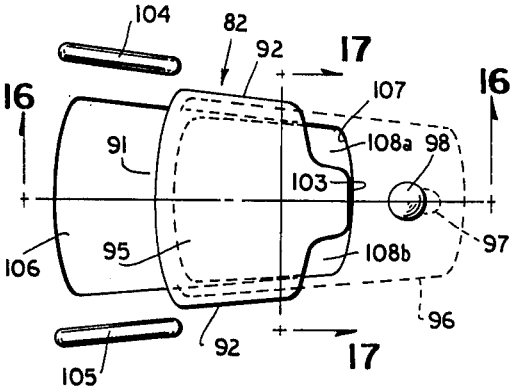
FIG. 15 is a top plan view of the embodiment shown in FIG. 12, in fully-opened position.
Figure 17:
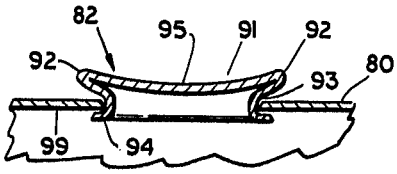
FIG. 17 is a section view taken along line 17—17 of FIG. 15.

As seen in FIGS. 15 and 17, the backward sliding movement of the separated openable member 82 causes the inwardly-necked channel 93 of the button 91 to become received even more positively between the confronting peripheral edges of the opening 106 in the end wall 79. This interlocking relation between the channel 93 and the end wall of the container further ensures that the openable member 82 cannot become detached from the end wall after opening. The embodiment of FIGS. 12–17 can be provided with the inwardly-beveled score construction previously described with respect to FIGS. 3A and 5A, to provide further assurance that the opening structure 81 will remain captivated to the end wall 79 of the container.

Figure 18:
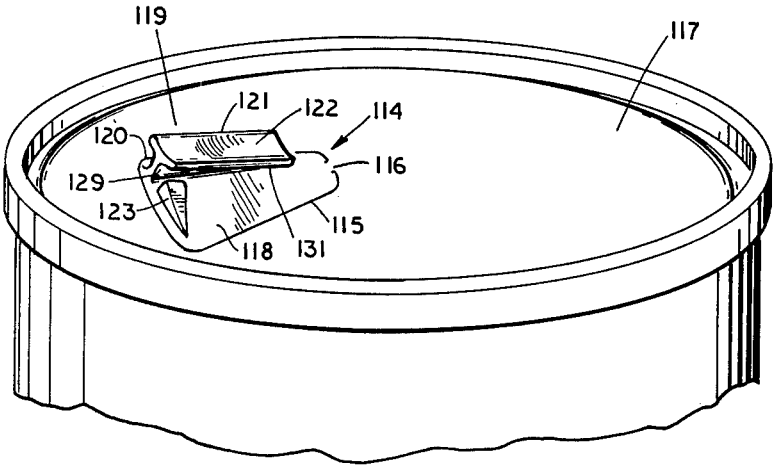
FIG. 18 is a fragmentary pictorial view of a container provided with easy-opening end structure according to yet another disclosed embodiment of the present invention.
Figure 19:
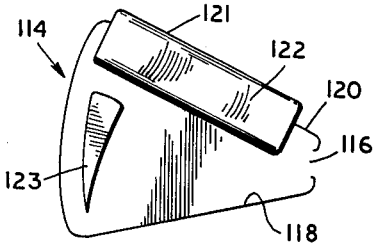
FIG. 19 is a top plan view of the embodiment shown in FIG. 18.
Figure 20:
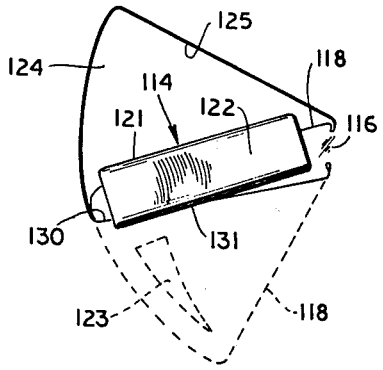
FIG. 20 is a top plan view of the embodiment shown in FIG. 18, in opened position.

Although the above-described embodiments of the present invention utilize an openable member which is defined by an uninterrupted score line, so that the openable member becomes completely separated from the wall of the container upon opening, the embodiment shown in FIGS. 18–20 utilizes an openable member indicated generally at 114 and defined by a score line 115 which is interrupted at 116 by unweakened end wall material so that the openable member remains attached to the end wall 117 when the score line 115 becomes ruptured.

The openable member 114, as defined on the end wall 117 by the score line 115, includes a tab 118 of approximately sector shape, as best seen in FIG. 19. A button 119 forms an opening tab which extends upwardly along one side 120 of the tab 118, with the button having a flange 121 which overhangs the end wall adjacent the side 120. A generally concave depression 122 is formed along the top surface of the button 109 to receive finger or thumb pressure. A wedge-shaped detent 123 extends outwardly from the outside surface of the tab 118.

Opening of the embodiment shown in FIGS. 18–20 is initiated by pressing downwardly on the button 119, whereupon the score line 115 becomes severed and the openable member 114 moves downwardly until the flange 121 contacts the end wall 117 adjacent the edge 125 of the opening 124. The openable member 114 remains attached to the end wall 117 by the interrupted portion 116, which does not become ruptured with the score line. The openable member 117 is now pivoted around a hinge provided by the interrupted portion 116 to slide the tab 118 beneath the end wall 117, as shown by broken line in FIG. 20, so that the opening 124 into the container is exposed. The interrupted portion 116 should be sufficiently flexible to permit the foregoing pivotal movement of the openable member 114. The side 129 of the button 119 provides a motion stop which engages the edge 130 of the opening 124 when the opening structures 114 is in fully-open position, and a second overhanging flange 131 may be provided on the button 119 to overhang the side 129 and prevent the button (and the finger of a user) from being inadvertently pressed downwardly into contact with the sharp edge 130. The raised detent 123 maintains the tab 118 spaced apart from the underside of the end wall 117, for venting purposes.

It will further be obvious that the foregoing relates only to disclosed embodiments of the present invention, and that numerous alterations and modifications may be made therein without departing from the spirit and the scope of the invention as defined in the following claims.

What is claimed is:

1. Easy opening container wall apparatus having unitary opening structure, comprising:

a wall having an outer side and an inner side;

an openable member defined in said wall by a selectably separable region of weakness;

an opening tab integrally formed with said openable member and extending a distance above said outer side, said opening tab having a portion which overhangs at least a portion of said separable region; and said opening tab being formed in said openable member so that said opening tab is a unitary portion of said openable member.

2. Apparatus as in claim 1 wherein said opening tab has a force receiving area to receive an externally applied force directed toward said openable member, so that said force is applied to initiate separation of said separable region.

3. Apparatus as in claim 1, wherein said unitary opening tab defines a peripheral wall which is necked inwardly from said separable region, and which is disposed between said openable member and said overhanging portion.

4. Apparatus as in claim 3, further comprising means associated with said separable region to provide an opening which prevents withdrawal of said separated openable member from said opening.

5. Apparatus as in claim 1, wherein said selectably separable region completely surrounds said openable member, so that said openable member becomes completely separated from the remainder of said wall upon separation of said separable region, whereupon said overhanging portion of said opening tab moves into contact with said outer side of said wall to prevent said openable member from freely entering said container.

6. Easy opening container apparatus comprising:

a container wall having an outer side and an inner side;

an openable member defined in said wall by a selectably separable region of weakness; and an opening tab which is an integral part of said openable member and which is spaced a distance above said outer side of said container wall to overhang at least a portion of said separable region, so that said overhanging opening tab moves toward said wall to contact said outer side and prevent said openable member from freely entering said container wall upon separation of said separable region.

7. Apparatus as in claim 6, wherein said integral opening tab comprises:

a peripheral wall which is located on said openable member a distance inside of said separable region, and which extends outwardly a distance from said outer side of said container wall; and a flange which is an extension of said peripheral wall and which extends outwardly from said peripheral wall to overhang at least a portion of said separable region, so that said peripheral wall and said flange define a channel for slidingly engaging the peripheral edge which is formed in said container wall upon separation of said separable region.

8. Apparatus as in claim 6, wherein said separable region is operative upon separation to provide an opening having peripheral means which obstructs withdrawal of said separated openable member from said opening.

9. Apparatus as in claim 6, wherein:

said openable member includes a portion which is not occupied by said opening tab; and said opening tab is spaced above said outer wall at least a sufficient distance to allow said unoccupied portion of said openable member to be displaced below the inner side of said container wall upon separation of said separable region, so that said unoccupied portion of the separated openable member can be displaced beneath said container wall by manipulation of said opening tab to expose a portion of the opening which is provided in said container wall upon separation of said separable region.

10. Apparatus as in claim 9, further comprising means associated with said container wall for retaining said separated openable member in said displaced relation with said container wall.

11. Apparatus as in claim 6, wherein:

said opening tab is positioned to enable a portion of said openable member to move below said inner side of said container wall upon separation of said separable region, so that an opening in said container wall can be exposed by manipulating the separated openable member to displace said portion thereof beneath said container wall.

12. Apparatus as in claim 11, wherein said separable region is operative upon separation to provide an opening having peripheral means which obstructs withdrawal of said separated openable member from said opening.

13. Apparatus as in claim 11, wherein said openable member is elongated and has an intermediate portion that is defined by a curvilinear extent of said separable region; and said opening tab overhang includes means to support said separated openable member for rotation about said curvilinear extent, so as to displace said portion of said openable member beneath said container wall.

14. Apparatus as in claim 11, wherein:

separable region includes a pair of opposed and spaced-apart mutually convergent portions;

said opening tab overhang comprises surface means positioned to be received between the convergent edges that are provided by said convergent portions when said separable region becomes separated; and said surface means is operative to engage said convergent edges when said separated opening slidably displaced so as to displace said portion of said openable member beneath said container wall, so that the maximum extent of said sliding displacement is limited by engagement between said surface means and said convergent means.

* * * * *